US010899578B2

(12) United States Patent
Laakso

(10) Patent No.: US 10,899,578 B2
(45) Date of Patent: Jan. 26, 2021

(54) ARRANGEMENT AND METHOD FOR DETECTING AT LEAST ONE OPERATIONAL PARAMETER OF AN AUTOMATIC DOOR

(71) Applicant: Kone Corporation, Helsinki (FI)

(72) Inventor: Matti Laakso, Helsinki (FI)

(73) Assignee: Kone Corporation, Helsinki (FI)

( * ) Notice: Subject to any disclaimer, the term of this patent is extended or adjusted under 35 U.S.C. 154(b) by 502 days.

(21) Appl. No.: 15/860,929

(22) Filed: Jan. 3, 2018

(65) Prior Publication Data

US 2018/0201476 A1 Jul. 19, 2018

(30) Foreign Application Priority Data

Jan. 17, 2017 (EP) ..... 17151782

(51) Int. Cl.

| | |
|---|---|
| ***B66B 5/00*** | (2006.01) |
| ***B66B 13/22*** | (2006.01) |
| ***E05F 15/40*** | (2015.01) |
| *E05F 15/646* | (2015.01) |

(52) U.S. Cl.

CPC ..... *B66B 5/0025* (2013.01); *B66B 5/0018* (2013.01); *B66B 13/22* (2013.01); *E05F 15/40* (2015.01); *B66B 5/005* (2013.01); *E05F 15/646* (2015.01)

(58) Field of Classification Search

CPC ..... B66B 5/0025; B66B 5/0018; B66B 5/005
USPC ..... 187/393
See application file for complete search history.

(56) References Cited

U.S. PATENT DOCUMENTS

| | | | | |
|---|---|---|---|---|
| 9,950,899 | B2 * | 4/2018 | Mattsson | B66B 1/3476 |
| 9,958,250 | B2 * | 5/2018 | Reilio | B66B 1/3492 |
| 2008/0135346 | A1 * | 6/2008 | Kattainen | B66B 1/3492 187/394 |
| 2013/0081906 | A1 * | 4/2013 | Studer | B66B 13/22 187/325 |
| 2014/0312884 | A1 * | 10/2014 | Reilio | G01P 3/42 324/207.11 |
| 2015/0068850 | A1 * | 3/2015 | Mattsson | B66B 1/3492 187/392 |
| 2016/0185569 | A1 * | 6/2016 | Sonnenmoser | B66B 5/0018 187/393 |

(Continued)

OTHER PUBLICATIONS

Extended European Search Report #17151782 dated Jul. 11, 2017.

*Primary Examiner* — David S Warren
(74) *Attorney, Agent, or Firm* — Harness, Dickey and Pierce, P.L.C.

(57) ABSTRACT

The invention relates to an arrangement for detecting operational information of an automatic door. The arrangement comprises a magnetometer arranged to at least one of the following: moving part of the door, structure that is separate from the moving part of the door. The arrangement further comprises at least one permanent magnet arranged to the other one of the following: moving part of the door, structure that is separate from the moving part of the door. The magnetometer is configured to detect data representing the magnetic field generated by the at least one permanent magnet during a predefined time. The arrangement further comprises a control unit configured to define the operational information of the door from the detected data. The invention also relates to a method for detecting operational information of an automatic door.

16 Claims, 7 Drawing Sheets

(56) References Cited

U.S. PATENT DOCUMENTS

| | | | | |
|---|---|---|---|---|
| 2016/0304313 | A1* | 10/2016 | Kinnari | B66B 1/3492 |
| 2017/0029244 | A1* | 2/2017 | Madarasz | B66B 5/0037 |
| 2018/0201476 | A1* | 7/2018 | Laakso | E05F 15/40 |
| 2020/0109030 | A1* | 4/2020 | Zhu | B66B 5/0037 |

* cited by examiner

ARRANGEMENT AND METHOD FOR DETECTING AT LEAST ONE OPERATIONAL PARAMETER OF AN AUTOMATIC DOOR

This application claims priority to European Patent Application No. EP171517824 filed on Jan. 17, 2017, the entire contents of which are incorporated herein by reference.

TECHNICAL FIELD

The invention concerns in general the technical field of an automatic door technology. Especially the invention concerns observation of an operation of the automatic door.

BACKGROUND

Automatic doors are used in a variety of environments, such as in elevators and in buildings. The automatic doors refer to door solutions in which the door is configured to be operated without specific action by a user of a door. Information about the at least one operational parameter of an automatic door is important for many reasons, for example for safety reasons. The at least one operational parameter of the automatic door may be at least state information or position information. For example the state information of the door gives advantageous information about the operation of the door. Different door states may be open, closed, or moving. For example, if the door is detected to perform multiple subsequent closing-opening cycles, it may indicate some failure in the operation of the door. Thus, it may be useful to observe the at least one operational information of the door.

According to one known solution the at least one operational parameter of the door may be obtained substantially accurately from the control system of the door. For example in elevator environment, at least one operational parameter of the door may be obtained from the elevator control system. However, if the access to the control system of the door is blocked or some other way unreachable for example due to unknown interface or protocol, the at least one operational parameter of the door cannot be obtained from the control system of the door. In that case other solutions for obtaining the at least one operational parameter of the door need to be found.

According to one prior art solution the operational parameter of the door, such as state or position, in the elevator environment may be obtained by means of a camera, such as a still camera or a video camera. Furthermore, the operational parameter of the door may be ascertained by means of a magnetometer attached to the elevator car. The magnetometer configured to measure the magnetic field around the measuring location is primarily intended to be used for determining the location and/or the speed of the elevator car travelling in an elevator shaft, but it may also be used to ascertain the state or position of the door of the elevator car, for example whether the elevator door is open or closed.

Hence, there is need to develop further solutions to detect at least one operational parameter of the door, when the access to the door control unit is unavailable.

SUMMARY

An objective of the invention is to present an arrangement and a method for detecting at least one operational parameter of the door of an automatic door. Another objective of the invention is that the arrangement and method for detecting at least one operational parameter of the door of the automatic door enable obtaining the at least one operational parameter of the door, when the access to a door control unit is not available.

The objectives of the invention are reached by an arrangement and a method as defined by the respective independent claims.

According to a first aspect, an arrangement for detecting at least one operational parameter of the door of an automatic door is provided, the arrangement comprising: a magnetometer arranged to at least one of the following: moving part of the door, structure that is separate from the moving part of the door, and at least one permanent magnet arranged to the other one of the following: moving part of the door, structure that is separate from the moving part of the door, so that the at least one permanent magnet is in an operational vicinity of the magnetometer at least at one point of a motion path of the door, wherein the magnetometer is configured to detect data representing the magnetic field generated by the at least one permanent magnet during a predefined time, and wherein the arrangement further comprising a control unit configured to receive and store the detected data from the magnetometer, and in response to receiving the detected data the control unit is configured to define the at least one operational parameter of the door of the door from the received data.

Moreover, the at least one operational parameter of the automatic door may be at least one of the following: state information, position information.

Furthermore, the state information of the door may be defined by comparing the detected data to an idle noise of the magnetometer.

Moreover, state information of the door may be defined to be: moving, if the variance of the detected data is defined to be higher than the idle noise of the magnetometer, open, if the variance of the detected data is defined to correspond to the idle noise of the magnetometer and if the average of the detected data is defined to differ from a door environment specific reference value more than a predefined limit, or closed, if the variance of the detected data is defined to correspond to the idle noise of the magnetometer and if the average of the detected data is defined to differ from the door environment specific reference value less than the predefined limit.

The door environment specific reference value may be an average value of previously detected and stored data representing the magnetic field created by the permanent magnet at the said door environment, when the door is defined to be in closed state.

Alternatively or in addition, the position information of the automatic door may be defined by comparing the detected data to a previously generated and stored magnetic map of the motion path of the door, wherein the magnetic map of the motion path of the door represents the magnetic field at each point of the motion path of the door.

Furthermore, the position of the door at the time of detection may be defined to be the point of the motion path of the door having magnetic field data corresponding to the detected data.

Furthermore, the data representing the magnetic field may be magnetic flux density, wherein the magnetic flux density is a vector quantity having strength, i.e. magnitude, and direction.

Alternatively or in addition, the magnetometer and the control unit may be implemented as one combined unit.

Furthermore, the moving part of the door may be one of the following: hanger plate, panel.

The arrangement may be implemented in an elevator environment in order to detect state information of a door of an elevator car. Alternatively or in addition, the arrangement may be implemented in a building environment in order to detect state information of a door of a building.

According to a second aspect, a method for detecting at least one operational parameter of an automatic door is provided, the method comprising: obtaining from a magnetometer data representing the magnetic field generated by at least one permanent magnet during a predefined time, wherein the magnetometer is arranged to at least one of the following: moving part of the door, structure that is separate from the moving part of the door, and the at least one permanent magnet is arranged to the other one of the following: moving part of the door, structure that is separate from the moving part of the door, so that the at least one permanent magnet is in an operational vicinity of the magnetometer at least at one point of a motion path of the door, storing the detected data from the magnetometer, and defining in response to receiving the detected data the at least one operational parameter of the door from the received data.

Moreover, the at least one operational parameter of the automatic door may be at least one of the following: state information, position information.

Furthermore, the state information of the door may be defined by comparing the detected data to an idle noise of the magnetometer.

Moreover, the state information of the door may be defined to be: moving, if the variance of the detected data is defined to be higher than the idle noise of the magnetometer, open, if the variance of the detected data is defined to correspond to the idle noise of the magnetometer and if the average of the detected data is defined to differ from a door environment specific reference value more than a predefined limit, or closed, if the variance of the detected data is defined to correspond to the idle noise of the magnetometer and if the average of the detected data is defined to differ from the door environment specific reference value less than the predefined limit.

Alternatively or in addition, the position information of the automatic door may be defined by comparing the detected data to a previously generated and stored magnetic map of the motion path of the door, wherein the magnetic map of the motion path of the door represents the magnetic field at each point of the motion path of the door.

Furthermore, the position of the door at the time of detection may be defined to be the point of the motion path of the door having magnetic field data corresponding to the detected data.

The exemplary embodiments of the invention presented in this patent application are not to be interpreted to pose limitations to the applicability of the appended claims. The verb "to comprise" is used in this patent application as an open limitation that does not exclude the existence of also un-recited features. The features recited in depending claims are mutually freely combinable unless otherwise explicitly stated.

The novel features which are considered as characteristic of the invention are set forth in particular in the appended claims. The invention itself, however, both as to its construction and its method of operation, together with additional objectives and advantages thereof, will be best understood from the following description of specific embodiments when read in connection with the accompanying drawings.

BRIEF DESCRIPTION OF FIGURES

The embodiments of the invention are illustrated by way of example, and not by way of limitation, in the figures of the accompanying drawings.

DESCRIPTION OF SOME EMBODIMENTS

Figure 1:
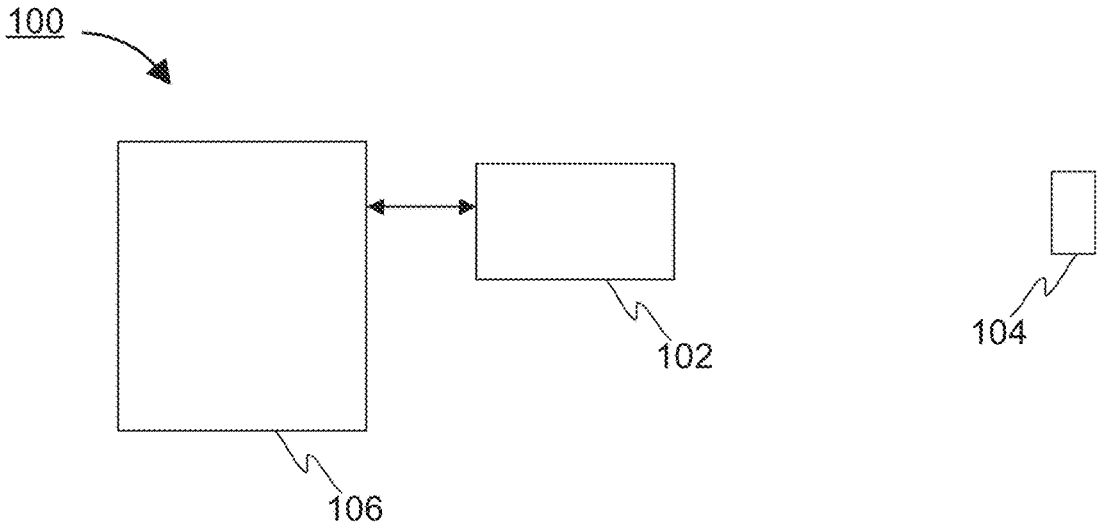
FIG. 1 illustrates schematically one example of the arrangement according to the invention.

FIG. 1 illustrates one simplified example of the arrangement 100 for detecting at least one operational parameter of an automatic door according to the invention. The at least one operational parameter of the automatic door may be at least one of the following: state information, position information. The arrangement 100 comprises a magnetometer 102, at least one permanent magnet 104, and a control unit 106. The strength, i.e. the pull strength of the at least one magnet 104 may be for example between 1 to 5 kg. This, however, is a non-limiting example and even weaker or stronger magnets may also be used. The stronger the magnet is the better signal to noise ratio the magnet provides. Especially, when the door environment comprises metal structures or objects, such as electric cabling, it is preferable to use relatively strong magnet. The pull strength may be defined as a force required for prizing a magnet away from a flat surface when the magnet and metal have full and direct surface-to-surface contact. The magnetometer 102 may be any sensor capable for detecting magnetic field. The magnetometer 102 may be at least one of the following: a vector magnetometer, 3D magnetometer. The magnetometer 102 is preferably configured to detect the magnetic field in vector format, i.e. the strength, i.e. magnitude, and the direction of the magnetic field.

The magnetometer 102 may be arranged to at least one of the following: moving part of the door 202, 302, structure that is separate from the moving part of the door 202, 302. The at least one permanent magnet 104 may be arranged to the other one of the following: moving part of the door 202, 302, structure that is separate from the moving part of the door 202, 302, so that the at least one permanent magnet 104 is in an operational vicinity of the magnetometer 102 at least at one point of a motion path of the door 202, 302. The motion path of the door 202, 302 is the trajectory along which the door 202, 302 is configured to travel. With the term operational vicinity of the magnetometer 102 is meant in the context of this application the distance from the magnetometer that is within the operating range of the magnetometer, i.e. the space around the magnetometer within the magnetometer may detect the magnetic field around it. The moving part of the door 202, 302 may be for example at least one of the following: hanger plate, panel. Alternatively or in addition, the moving part of the door may be any part of the door that is configured to move together with the door. The structure that is separate from the moving part of the door 202, 302 may be any structure arranged to the environment of the door 202, 302, for example door frame, wall, ceiling, rail along which the door is configured to move, or any fixed structure that may be arranged around the door 202, 302. The at least one permanent magnet 104 may be arranged to the moving part of the door 202, 302 or to the structure that is separate from the moving part of the door 202, 302 by means of the magnetic attraction of the at least one permanent magnet 104. Thus, the installation of the at least one permanent magnet 104 is quick and easy. Furthermore, the installation location of the at least one permanent magnet 104 does not need to be exact, which also enables quick and easy installation.

The arrangement 100 according to the invention may be implemented at least in the following environments: an elevator environment, building environment.

Figure 2A:
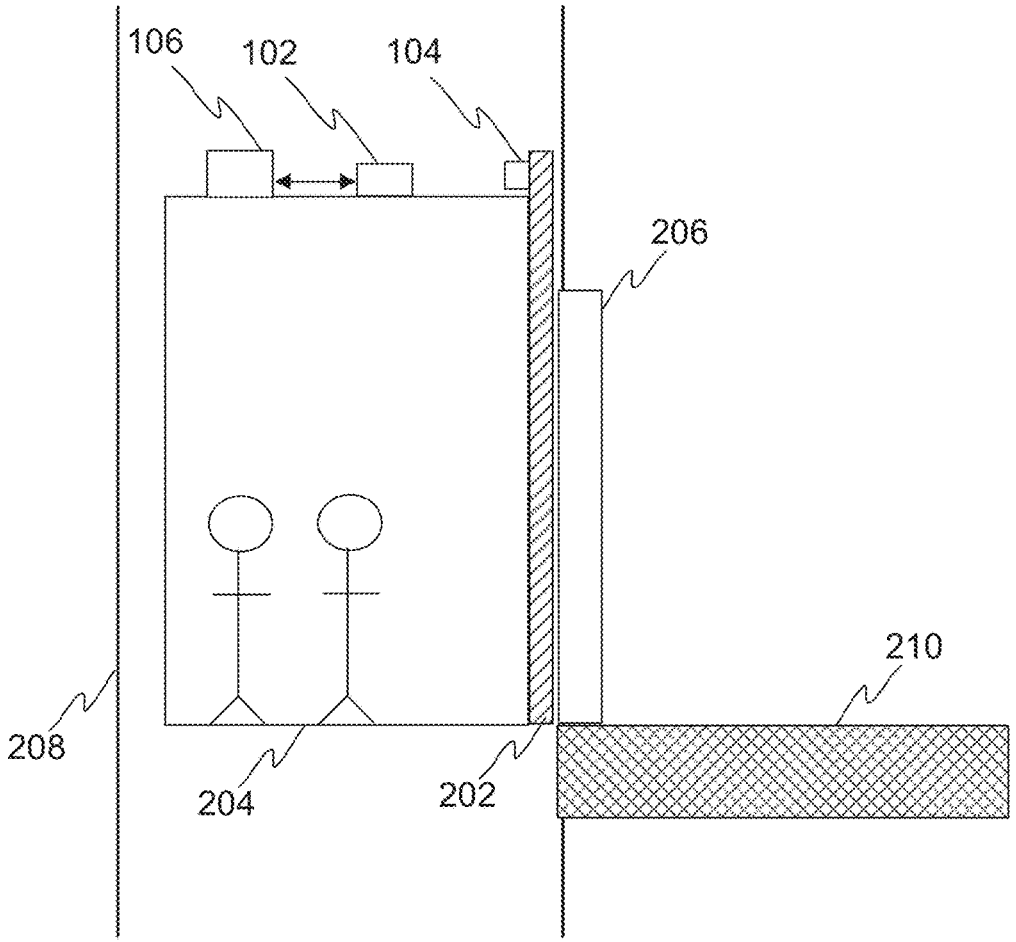
FIG. 2A illustrates schematically one example of the arrangement according to the invention implemented in an elevator environment.
Figure 2B:
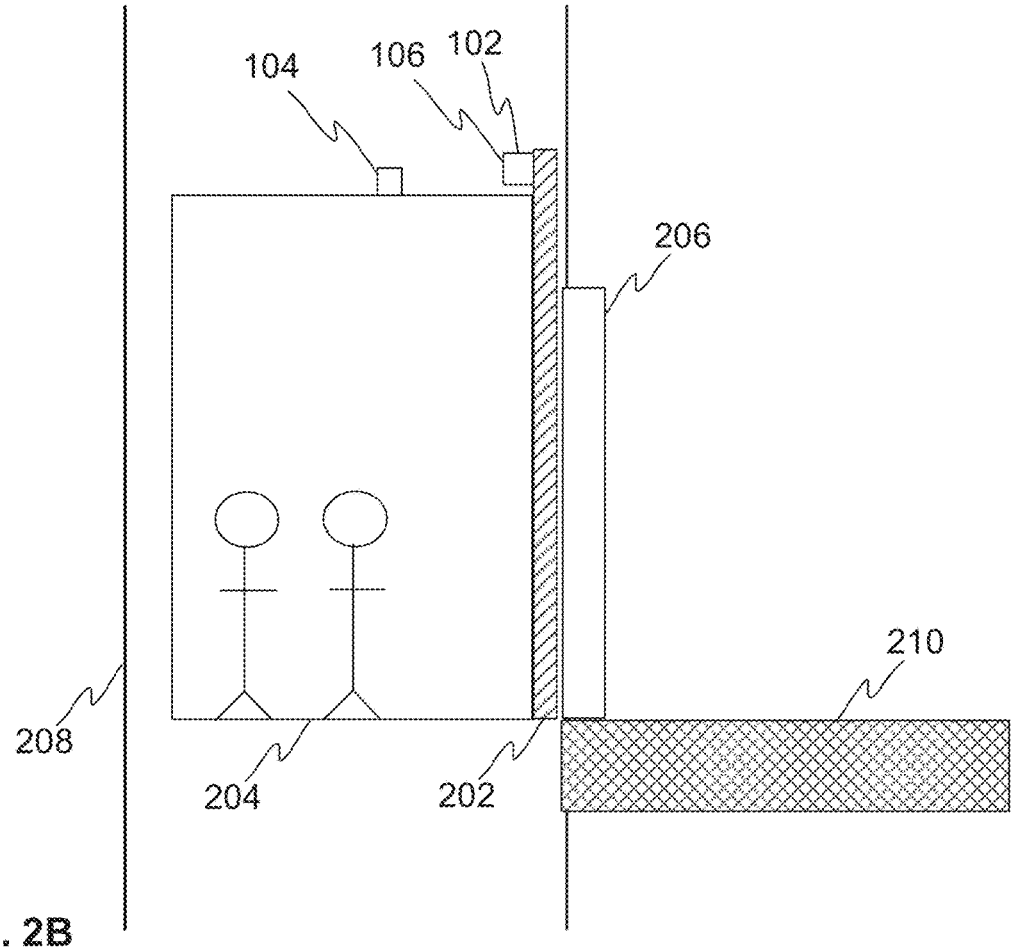
FIG. 2B illustrates schematically another example of the arrangement according to the invention implemented in an elevator environment.

FIGS. 2A and 2B illustrate some examples of the arrangement 100 according to the invention implemented in the elevator environment, wherein the arrangement 100 is configured to detect at least one operational parameter of an elevator door 202. The elevator comprises an elevator car 204 and a hoisting machine configured to drive the elevator car 204 in an elevator shaft 208 between the floors 210. An elevator control system may be configured to control the operation of the elevator. For sake of clarity the elevator at a location of one floor is illustrated in FIGS. 2A and 2B. Furthermore, for sake of clarity the hoisting machine and the elevator control system are not shown in FIGS. 2A and 2B.

In FIG. 2A is illustrated an example of the invention implemented in the elevator environment, wherein the magnetometer 102 and the control unit 106 communicatively coupled to the magnetometer 102 are arranged to the roof of the elevator car 204 and the at least one permanent magnet 104 is arranged to a moving part of the elevator door 202, wherein the moving part may be a hanger plate of the door 202, for example. In FIG. 2B is illustrated another example of the invention implemented in the elevator environment, wherein the magnetometer 102 and the control unit 106 communicatively coupled to the magnetometer 102 are arranged to a moving part of the elevator door 202, such as to a hanger plate of the door 202, and the at least one permanent magnet 104 is arranged to the roof of the elevator car 204. For sake of clarity in FIG. 2B only one unit arranged to the moving part of the door 202 is shown, however the unit comprises both the magnetometer 102 and the control unit 106 as the reference numbers in FIG. 2B indicate. In the elevator environment the moving part of the door 202 may be also a landing door 206 in addition to the above discussed examples of the moving part of the door. Alternatively or in addition, in the elevator environment the structure that is separate from the moving part of the door 202, 302 may be also at least one of the following: elevator car 204, elevator car frame, or any other part moving along the elevator car 204 in addition to the above discussed structures that are separate from the moving part of the door.

Figure 3A:
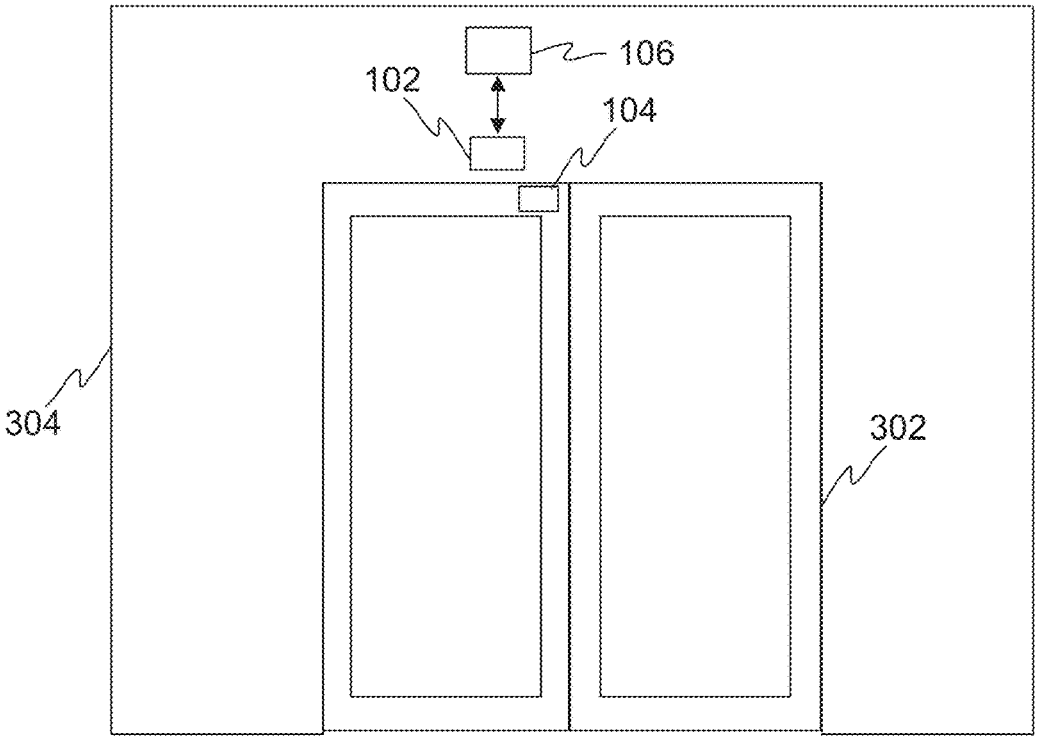
FIG. 3A illustrates schematically one example of the arrangement according to the invention implemented in a building environment.
Figure 3B:
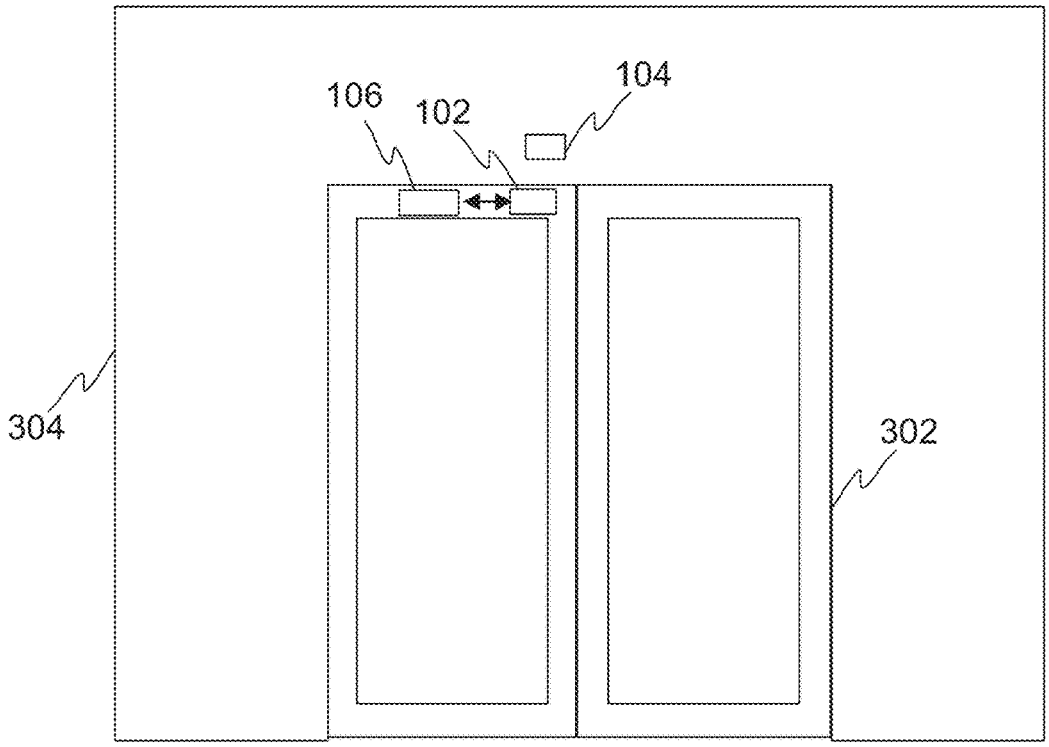
FIG. 3B illustrates schematically another example of the arrangement according to the invention implemented in a building environment.

FIGS. 3A and 3B illustrate some examples of the arrangement 100 according to the invention implemented in the building environment, wherein the arrangement 100 is configured to detect at least one operational parameter of an automatic door 302 of a building. In FIG. 3A is illustrated an example of the invention implemented in the building environment, wherein the magnetometer 102 and the control unit 106 communicatively coupled to the magnetometer 102 are arranged on a wall 304 of the building and the at least one permanent magnet is arranged to a moving part of the automatic door 302, wherein the moving part may be a hanger plate of the door 302, for example. Alternatively or in addition, the structure that is separate from the moving part of the door to which the magnetometer 102 is arranged may be other than the wall as described above. In FIG. 3B illustrated another embodiment of the invention implemented in the building environment, wherein the magnetometer 102 and the control unit 106 communicatively coupled to the magnetometer 102 are arranged to a moving part of the automatic door 302, such as to a hanger plate of the door 302, and the at least one permanent magnet 104 is arranged on the wall 304 of the building. Alternatively or in addition, the structure that is separate from the moving part of the door to which the at least one permanent magnet 104 is arranged may be other than the wall 304 as described above.

When the door 202, 302 is configured to move along the motion path of the door 202, 302, the magnetic field generated by the at least one permanent magnet 104 changes the magnetic field at the site of the magnetometer 102 depending on the position of the door 202, 302. The magnetometer 102 is configured to detect data representing the magnetic field generated by the at least one permanent magnet 104 during a predefined time. The data representing the magnetic field may be for example magnetic flux density, wherein the magnetic flux density is a vector quantity having strength, i.e. magnitude, and direction. The predefined time may be a short time, such as 100-750 milliseconds, so that the at least one operational parameter of the door 202, 302 is not changed during the detection. Moreover, the predefined time may be preferably 500 milliseconds, for example. Furthermore, the magnetometer 102 is configured to transmit the detected data to the control unit 106. The control unit 106 is configured to receive and store the detected data from the magnetometer 102. The data received by the control unit 106 from the magnetometer 102 may be the raw data detected by the magnetometer 102 or it may be data processed by the magnetometer 102 before transmitting the data to the control unit 106. In response to receiving the detected data the control unit 106 is further configured to define the at least one operational parameter of the automatic door 202, 302 from the received data.

Next it is described how the state information of the automatic door 202, 303 is defined from the received data. Alternatively or in addition, the position information of the automatic door 202, 203 may be defined from the received data as will be described later in this application. The control unit 106 may define the state information of the door 202, 302 by comparing the detected data to an idle noise of the magnetometer 102. The idle noise of the magnetometer 102 may be a predefined magnetometer specific value representing the noise that is present when no signal is applied to the magnetometer 102.

The state information of the door 202, 302 may be at least one of the following: moving, open, closed. The control unit 106 may define the state information to be moving, if the variance of the detected data is defined to be higher than the idle noise of the magnetometer 102. Alternatively, if the variance of the detected data is defined to correspond to the idle noise of the magnetometer 102, the state information may be defined to be open or closed. In order to define whether the state information of the door 202, 302 is open or closed, the control unit 106 is further configured to compare the detected data to a door environment specific reference value. If the average of the detected data is defined to differ from the door environment specific reference value more than a predefined limit, the state information of the door 202, 302 may be defined to be open. Alternatively, if the average of the detected data is defined to differ from the door environment specific reference value less than the predefined limit, the state information of the door 202, 302 may be defined to be closed.

The door environment specific reference value is an average value of previously detected and stored data representing the magnetic field created by the at least one permanent magnet at said door environment, when the door 202, 302 is defined to be in the closed state. Before the arrangement may be taken into actual operation one or more test runs are carried out in the operation environment of the arrangement in order to generate initial value for each door environment specific reference values. For example in the elevator environment the one or more test runs may be carried out at each floor in order to generate initial values for the door environment specific reference values at each floor. Each door 202, 302 has its own door environment that has an influence on the magnetic field around the door 202, 302. Each metal structures or objects around the door 202, 302 change the magnetic field around the door 202, 302. Typically there are fixed structures or objects, such as door frame, wall, ceiling or floor, which each comprises metal, in the door environment causing a characteristic magnetic field of that door environment. This characteristic magnetic field of each door environment caused by fixed structures or object in the door environment may be considered to be substantially static in relation to time. Each door may be recognized by means of the characteristic magnetic field of the door environment of said door, if the characteristic magnetic field of each door environment is known. For example in the elevator environment there are several structures or objects that have an influence on the magnetic field of each door environment. For example elevator shaft 208, counterweight, hoisting ropes, and floor levels 210 cause different magnetic field for each door environment at different floors.

The predefined limit of the door environment specific reference value may depend on the number of permanent magnets 104, distance between the magnetometer 102 and the at least one magnet 104, and the level of the idle noise of the magnetometer 102, for example. The predefined limit may be for example between 2.5-10 μT. Preferably, the predefined limit may be 5 μT in order to reliably define the difference between open and closed states. This, however, is a non-limiting example.

Above it is described how the state information of the automatic door may be defined from the detected data. Next it is described how the position information of the door at the time of the detection may be defined from the detected data. Because the magnetometer is configured to detect the magnetic field as a vector format, the arrangement described above may also be implemented to define position information of the automatic door at the motion path of the door from the detected magnetic field.

The control unit 106 may be configured to define the position information of the automatic door 202, 302 by comparing the detected data to a previously generated and stored magnetic map of the motion path of the door 202, 302. The magnetic map of the motion path of the door 202, 302 represents the magnetic field at each point of the motion path of the door 202, 302. As described above before the arrangement 100 may be taken into actual operation one or more test runs are carried out in the operation environment of the arrangement 100 in order to generate initial value for each door environment specific reference values. Alternatively or in addition, the magnetic map of the motion path of the door may be detected and stored during the one or more test runs.

As also described above each door 202, 302 has its own door environment that has an influence on the magnetic field around the door 202, 302. Furthermore, also each point of the motion path of each door has its own characteristic magnetic field, which may be considered to be substantially static in relation to time. Thus, if the magnetic field at each point of the motion path of the door is known, i.e. previously defined, the position information of the door may be defined by comparing the detected data to the magnetic map of the motion path of the door. The position of the door at the time of detection may be defined to be the point of the motion path of the door having magnetic field data corresponding to the detected data representing the magnetic field.

In the elevator environment the above described detection may be started when the elevator car 204 is defined to arrive to at least one door zone of the elevator shaft 208. The door zone may be defined as a zone extending from a lower limit below floor level to an upper limit above the floor level in which the landing door 206 and the elevator car door 202 are in mesh and operable. The door zone may be determined to be from −400 mm to +400 mm for example. Preferably, the door zone may be from −150 mm to +150 mm. When arriving to the door zone the elevator car 204 is allowed to begin to open the doors even before the elevator car 204 is stopped.

Above it is defined that the at least one permanent magnet 104 is arranged in the operational vicinity of the magnetometer 102 at least at one point of a motion path of the door 202, 302. In addition, in order to maximize the change in the magnetic field as the door 202, 302 is moving along its motion path, the magnetometer 102 may be arranged in such a way that the distance from the magnetometer 102 to the at least one permanent magnet 104 is at its minimum, when the door 202, 302 is in the open state. In other words the magnetometer 102 may be arranged at a distance from the at least one permanent magnet 104, wherein the distance is defined to be at its minimum, when the door 202, 302 is in an open state.

As described above the arrangement 100 according to the invention is operable by using one permanent magnet 104. However, by using multiple permanent magnets 104 the magnetic field generated by the at least one permanent magnet 104 may be strengthen in comparison to using one permanent magnet 104. Thus, also the detected data representing the magnetic field generated by the at least one permanent magnet 104 may be amplified. Furthermore, by using multiple permanent magnets 104 the signal to noise ratio may be increased in comparison to using one permanent magnet 104. When multiple permanent magnets 104 are used the permanent magnets 104 may be arranged to the moving part of the door 202, 302 or to the structure that is separate from the moving part of the door 202, 302 in several ways. For example the multiple permanent magnets 104 may be stacked on top of each other. Alternatively or in addition, the multiple permanent magnets 104 may be arranged to the moving part of the door 202, 302 or to structure that is separate from the moving part of the door 202, 302 so that the multiple permanents magnets 104 are arranged a distance from each other in any kind of formation.

According to one embodiment of the invention implemented in the elevator environment the multiple permanent magnets 104 may be arranged to the landing door 206 in different ways at each floor in order to increase the difference between the characteristic magnetic fields of each floor. In this way the door environment reference value of each floor may be individualized even more. This enables that each floor may be recognized by means of the door environment reference value. The multiple magnets 104 may be arranged differently at each floor so that each floor has different amount of permanent magnets 104, the location of the multiple permanent magnets 104 is different at each floor, the orientation of the multiple permanent magnets 104 is different at each floor, and/or the strength of the multiple permanent magnets 104 is different at each floor, for example.

Figure 4:
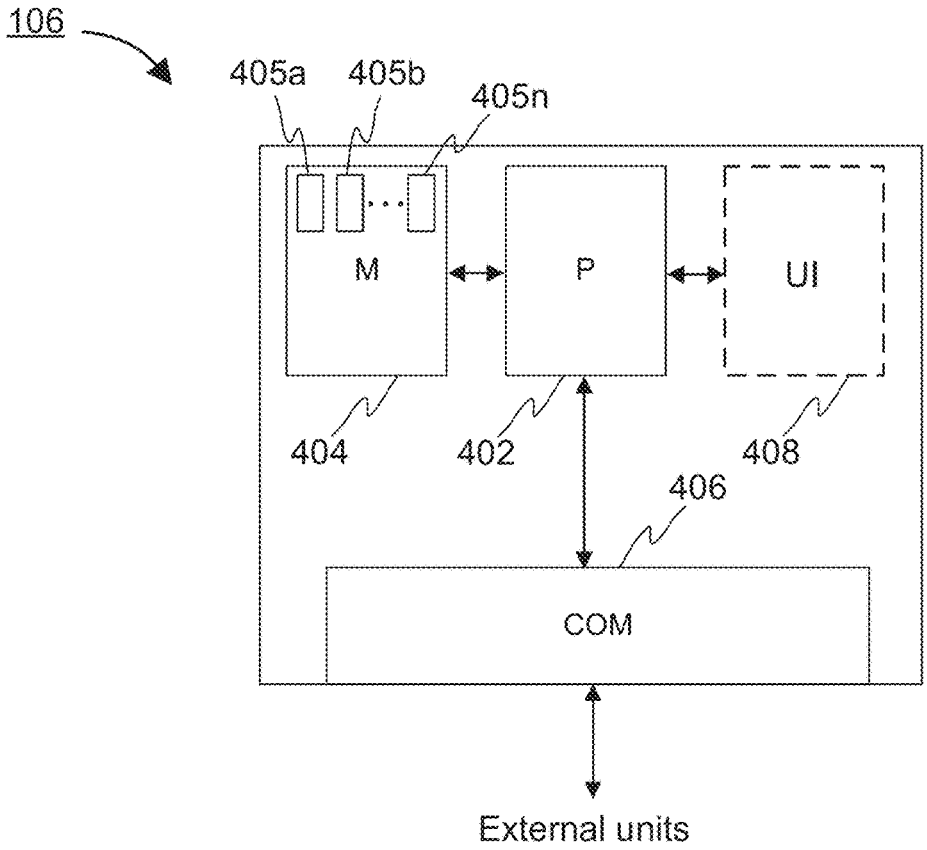
FIG. 4 illustrates schematically one example of a control unit according the invention.

FIG. 4 illustrates schematically an example of the control unit 106 according to the invention. The control unit 106 may comprise at least one processor 402, at least one memory 404, and a communication interface 406. The control unit 106 may further comprise at least one user interface 408. The at least one memory 404 may be volatile or non-volatile. Furthermore, the at least one memory 404 is configured to store portions of computer program code 405*a*-405*n* and any data values or parameters. The at least one memory 404 is not limited to a certain type of memory only, but any memory type suitable for storing the described pieces of information may be applied in the context of the invention. Similarly, the at least one processor 402 herein refers to any unit suitable for processing information and control the operation of the control unit 106, among other tasks. The operations may also be implemented with a microcontroller solution with embedded software. The above mentioned elements may be communicatively coupled to each other with e.g. an internal bus. The communication interface 406 provides an interface for communication with any external unit, such as magnetometer 102, database and/or external systems. The communication interface 406 may be based on one or more known wired or wireless communication technologies, in order to exchange pieces of information as described earlier.

The at least one processor 402 of the control unit 106 is at least configured to implement at least some of the above described operations of the control unit 106 and the method step described later for detecting at least one operational parameter of an automatic door 202, 302. The implementation of the operations and/method steps may be achieved by arranging the at least one processor 402 to execute at least some portion of computer program code 405*a*-405*n* stored in the at least one memory 404 causing the at least one processor 402, and thus the control unit 106, to implement one or more operations as described above. The at least one processor 106 is thus arranged to access the at least one memory 404 and retrieve and store any information therefrom and thereto.

Alternatively or in addition to the above described, the communication interface 406 of the control unit 106 may be also used for providing power to the control unit 106. Moreover, the control unit 106 may be powered via the communication interface 406 by mains or any external device, for example. Alternatively or in addition, the control unit 106 may comprise a battery in order to provide power to the control unit 106.

Figure 5:
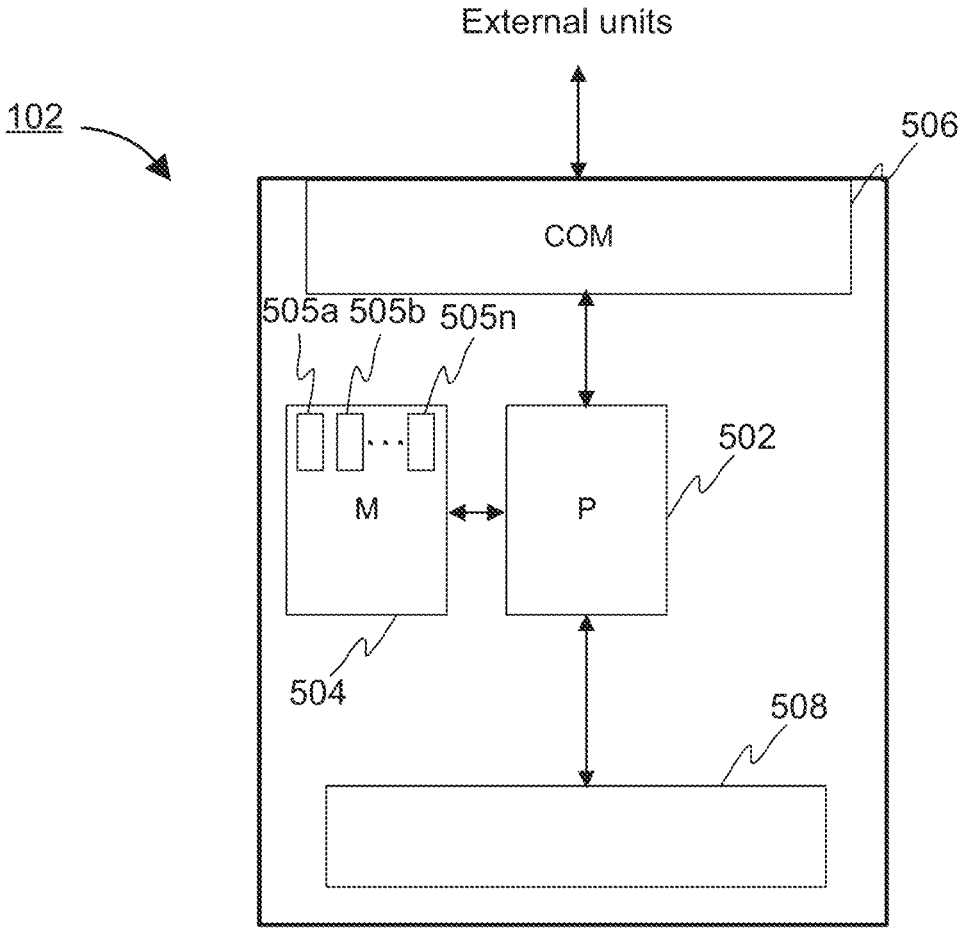
FIG. 5 illustrates schematically an example of a magnetometer according the invention.

FIG. 5 illustrates a schematic example of a magnetometer according to the invention. The magnetometer 102 may comprise one or more processors 502, one or more memories 504 being volatile or non-volatile for storing portions of computer program code 505*a*-505*n* and any data values or parameters, a communication interface 506, and detecting related devices 508 for detecting the magnetic field. The mentioned elements may be communicatively coupled to each other with e.g. an internal bus. The communication interface 506 provides interface for communication with any external unit, such as with control unit 106. The communication interface may be based on one or more known communication technologies, either wired or wireless, in order to exchange pieces of information as described earlier.

Alternatively or in addition to the above described, the communication interface 506 of the magnetometer 102 may also be used for providing power to the magnetometer 102 from mains of any external unit, such as the control unit 106. Alternatively or in addition, the magnetometer 102 may comprise a battery in order to provide power to the magnetometer 102.

Above it is described so that arrangement 100 by the magnetometer 102 and the control unit 106 are implemented as separate units that are communicatively coupled to each other. Alternatively, the magnetometer 102 and the control unit 106 may be implemented as one combined unit comprising the magnetometer 102 and the control unit 106.

Figure 6:
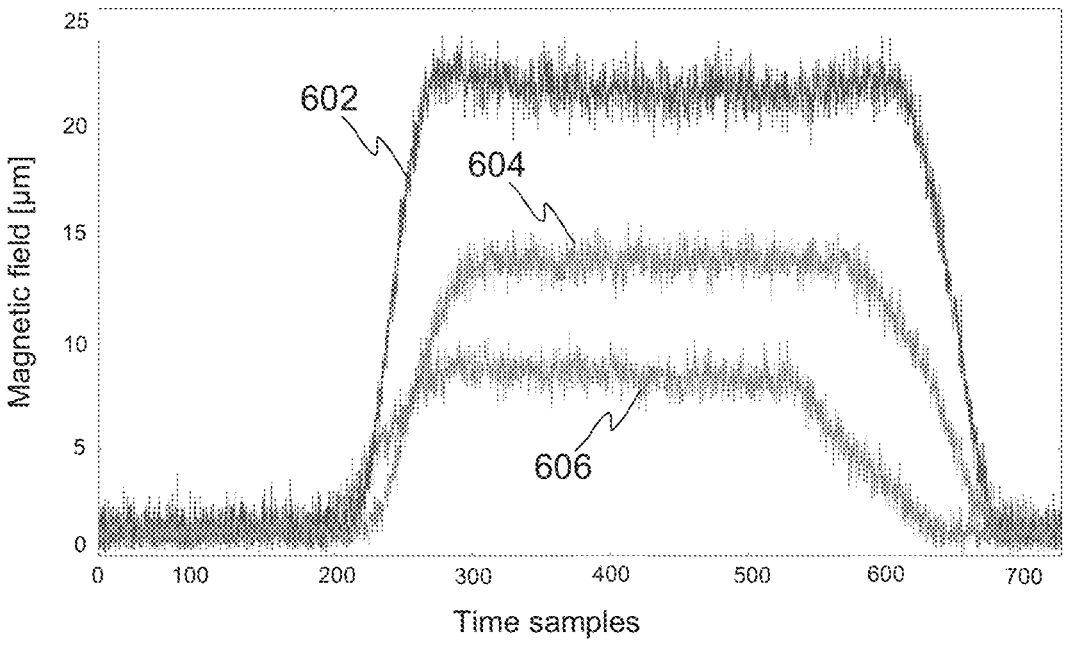
FIG. 6 illustrates schematically one example of results obtained with the arrangement according to the invention.

FIG. 6 illustrates some example results obtained with an example arrangement according to the invention for detecting at least one operational parameter of an automatic door. In this example the arrangement is implemented in elevator environment and the operational parameter is the state information. One permanent magnet having pull strength of 2.4 kg is attached to a hanger plate of the automatic door and the magnetometer is arranged on the roof of the elevator car close to the center line of the door opening. The example results are achieved by arranging the magnetometer at three different distances from the door. The three distances used in the example are 0, 30, and 60 centimeters. The control unit is communicatively coupled to the magnetometer and arranged also on the roof of the elevator car.

In FIG. 6 the detected magnetic field is presented as a function of time, i.e. on the x-axis is presented time samples and on the y-axis is presented the detected magnetic field density. The line 602 represents the detected magnetic field, when the distance between the magnetometer and the door is 0 centimeters. The line 604 represents the detected magnetic field, when the distance between the magnetometer and the door is 30 centimeters. The line 606 represents the detected magnetic field, when the distance between the magnetometer and the door is 60 centimeters. The example results illustrated in FIG. 6 clearly presents that the detected magnetic field is higher when the magnetometer is closer to the door and thus also closer to the magnet.

Furthermore, it can be seen from FIG. 6 that the automatic door starts to open around time sample 200 (depending on the distance between the magnetometer and the door), wherein the detected magnetic field is more than the predefined limit, which is in this example 5 μT. Before that the door may be defined to be closed, because the detected magnetic field is less than the predefined limit, i.e. 5 μT. Furthermore, the door may be defined to be fully open around time sample 300, where the detected magnetic field settles to a steady level. Around time samples 500-600

(depending again on the distance between the magnetometer and the door) the door starts to close and is detected to be fully closed around the samples 650 (depending again on the distance between the magnetometer and the door). The above example shows that the state of the automatic door may be defined with the arrangement according to the invention.

Figure 7:
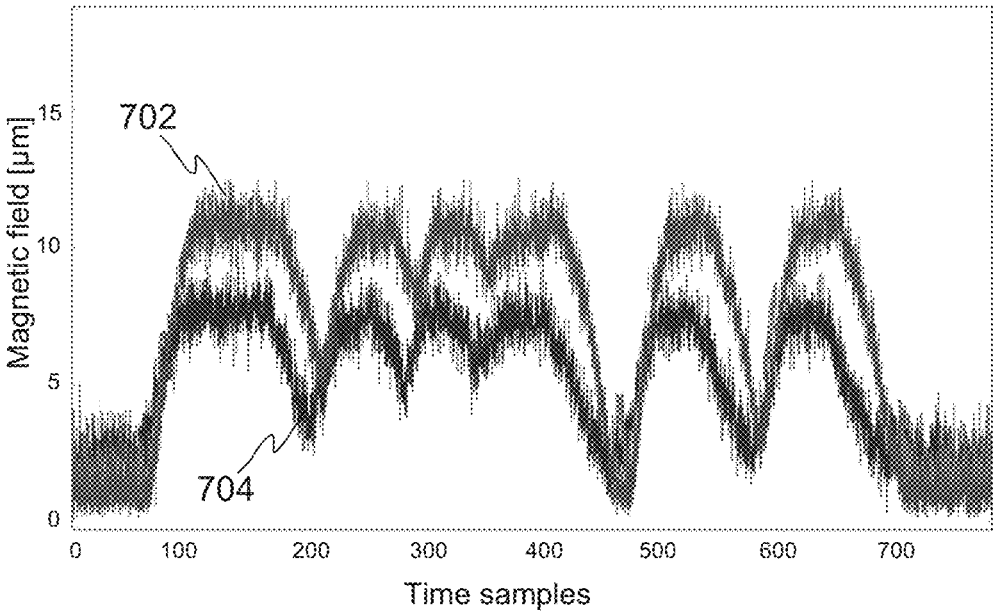
FIG. 7 illustrates schematically another example of results obtained with the arrangement according to the invention.

FIG. 7, in turn, illustrates another example results with the same example arrangement as described above, wherein the detection of automatic door reopenings is illustrated. The line 702 represents the detected magnetic field, when the distance between the magnetometer and the door is 30 centimeters. The line 704 represents the detected magnetic field, when the distance between the magnetometer and the door is 60 centimeters. In this example the automatic door is arranged to open and close six times so that the door is not fully closed every time, but in some cases the door is arranged to close only a little and to reopen before the door is fully closed. From the lines 702 and 704 illustrating the detected magnetic field from distances of 30 and 60 centimeters, respectively, can be easily deduced all the openings and closings of the automatic door. Furthermore, it can be deducted that the door is not fully closed at least around time samples 200, 300, and 350. The above example shows that the number of reopenings of the automatic door may be deducted with the arrangement according to the invention. Furthermore, from the detected magnetic field data the time spent in the opening state may be deducted.

The above presented examples relating to FIGS. 6 and 7 do not limit the invention anyhow and the inventive idea is directly applicable in any other implementation according to the invention.

Figure 8:
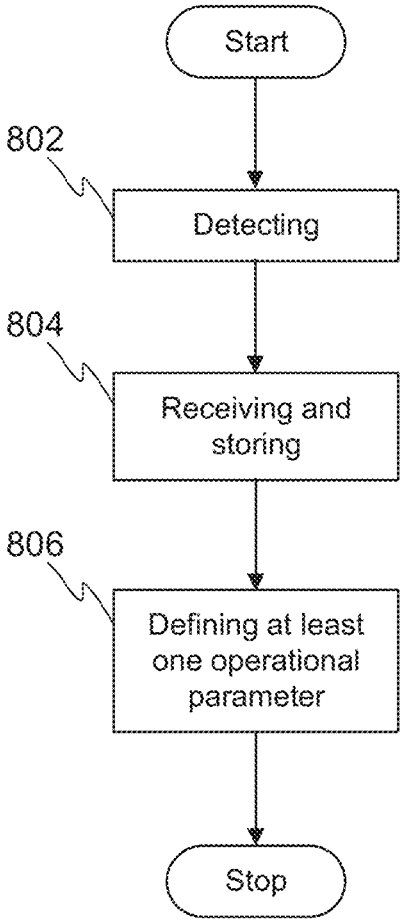
FIG. 8 illustrates schematically an example of the method according to the invention.

In addition to the arrangement 100 presented above the invention relates to a method for detecting at least one operational parameter of an automatic door by using the above presented arrangement 100. Next an example of the method according to the invention is described by referring to FIG. 8. FIG. 8 schematically illustrates the method according to the invention as a flow chart. As already described the magnetometer detects 802 data representing the magnetic field generated by at least one permanent magnet during a predefined time. Next the control unit receives and stores 804 the detected data from the magnetometer. In response to receiving the detected data the control unit defines 806 the at least one operational parameter of the door from the received data.

Figure 9:
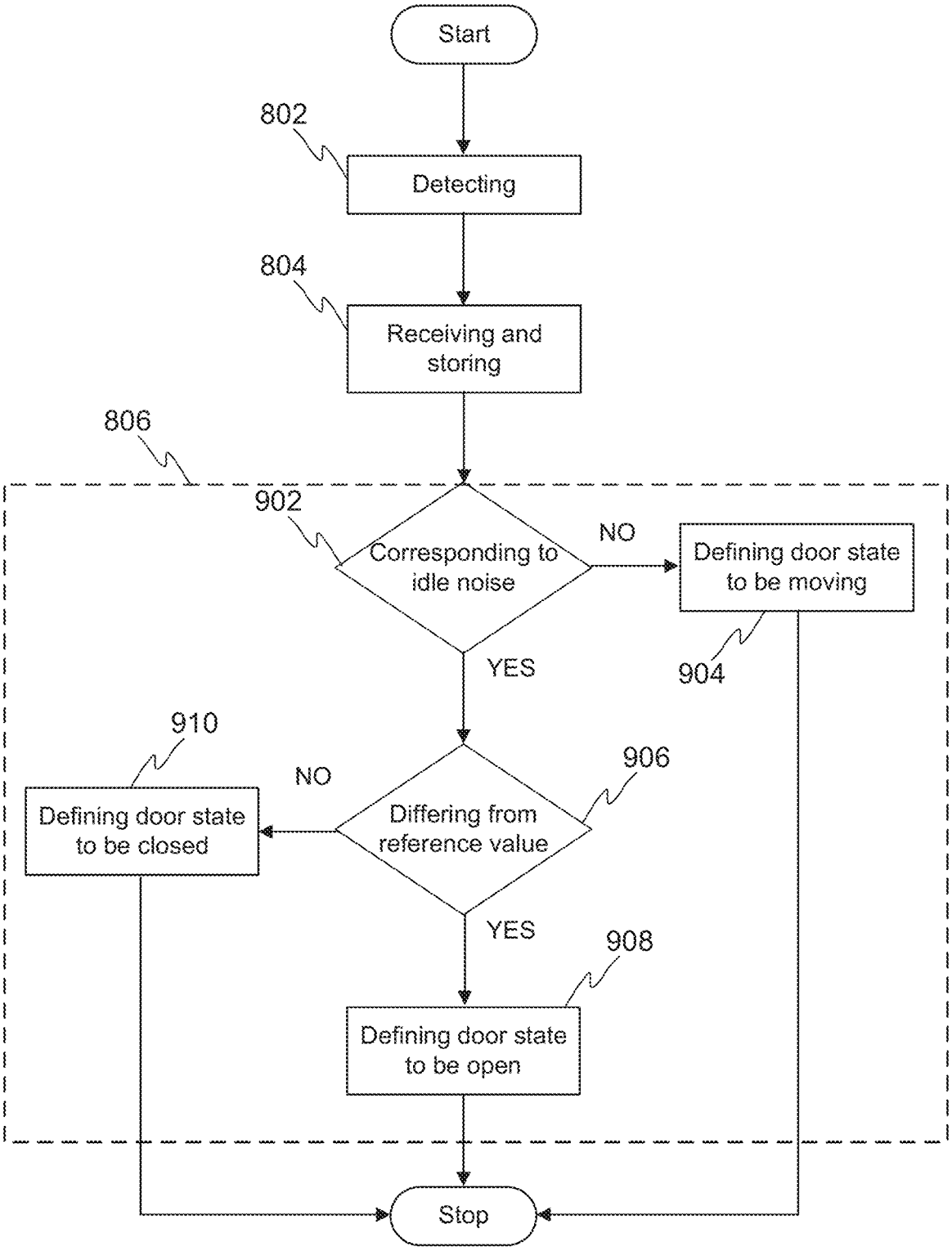
FIG. 9 illustrates schematically a more detailed example of the method according to the invention.

FIG. 9 schematically illustrates the flow chart of FIG. 8 in more detailed manner, wherein the at least one operational parameter is the state information of the automatic door 202, 302. Especially the step 806 becomes clear from FIG. 9. The state information of the door may be defined by comparing the detected data to the idle noise of the magnetometer as described. The idle noise of the magnetometer may be a predefined magnetometer specific value representing the noise that is present when no signal is applied to the magnetometer. The control unit defines 806 the state information of the door by comparing 902 the detected data to the idle noise of the magnetometer. The control unit may define the state information of the door to be moving 904 if the variance of the detected data is defined to be higher than the idle noise of the magnetometer. Alternatively, if the variance of the detected data is defined to correspond to the idle noise of the magnetometer, the control unit compares 906 the detected data to a door environment specific reference value as described in order to define whether the state information of the door is open or closed. If the average of the detected data is defined to differ from the door environment specific reference value more than a predefined limit, the control unit defines 908 that the state information of the door may be open. Alternatively, if the average of the detected data is defined to differ from the door environment specific reference value less than the predefined limit, the control unit defines 910 that the state information of the door may be closed. The door environment specific reference value may be an average value of previously detected and stored data representing the magnetic field created by the at least one permanent magnet at said door environment, when the door 202, 302 is defined to be in the closed state as described earlier.

Figure 10:
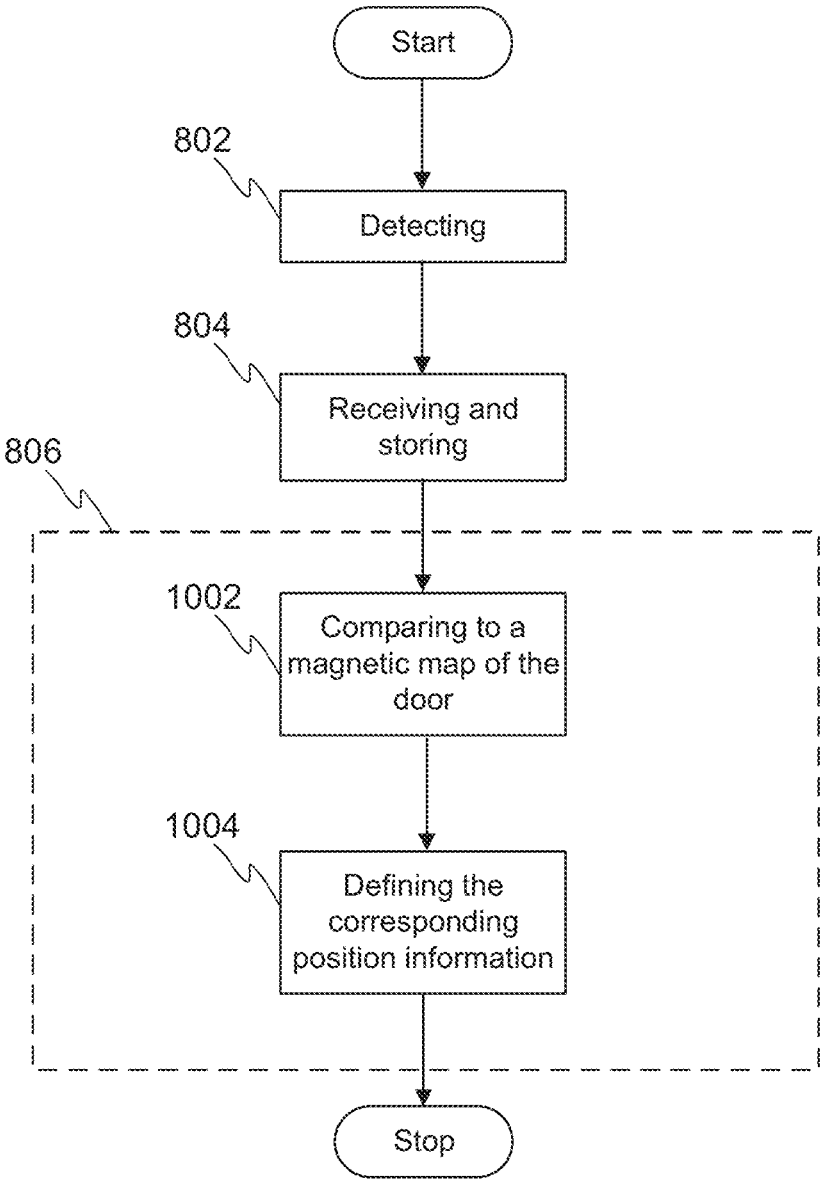
FIG. 10 illustrates schematically another more detailed example of the method according to the invention.

FIG. 10 schematically illustrates the flow chart of FIG. 8 in more detailed manner, wherein the at least one operational parameter of the automatic door is position information of the automatic door 202, 302. Especially the step 806 becomes clear from FIG. 10. The control unit defines 806 the position information of the door by comparing 1002 the detected data to a previously generated and stored magnetic map of the motion path of the door wherein the magnetic map of the motion path of the door represents the magnetic field at each point of the motion path of the door as described above. The magnetic map of the motion path of the door may be detected and stored during the one or more test runs as also described earlier. The control unit defines 1004 the position of the door at the time of detection to be the point of the motion path of the door having magnetic field data corresponding to the detected data representing the magnetic field.

It is worthwhile to mention here that also the moving parts of the door 202, 302 or the structure that is separate from the moving part of the door 202, 302 are typically made of metal, which naturally generates also at least a small magnetic field, which the at least one permanent magnet 104 is configured to amplify when attached to it. Thus, throughout this application the magnetometer 102 is configured to detect the magnetic field generated by the at least one permanent magnet 104 together with the magnetic field generated by the moving parts of the door 202, 302 or the structure that is separate from the moving part of the door 202, 302.

The arrangement 100 and the method described above may be used to accurately provide the at least one operational parameter of the automatic door. In order to accurately define the position information of the automatic door, the at least one permanent magnet is required to generate a magnetic field having a magnitude that may be distinguished from the magnetic noise around the door environment, i.e. the at least one magnet is required to be relatively strong, for example even more than 5 kg. The magnetic noise around the door environment may be caused for example by cablings, motor or other structures or objects comprising metal. The state information of the automatic door, in turn, may be defined accurately even with at least one permanent magnet generating only a weak magnetic field, for example with a permanent magnet having strength even less than 1 kg.

Furthermore, from the detected data representing the state information of the automatic door the time spent in the open state and the number of reopenings, which are two most important characteristics of door operation, may be deduced. More over the arrangement described above enables an arrangement for detecting the at least one operational parameter of an automatic door, wherein the arrangement does not require anything to be connected with a wire to the moving parts of the automatic door, because no wires are needed between the magnetometer and the at least one permanent magnet. Furthermore, the arrangement presented above does not require a battery powered devices to be installed to the door panel because of using permanent magnets.

The above described arrangement 100 and method according to the invention may be used especially, when the access to a door control system is not available, for example due to unknown interface or protocol in order to obtain accurately the state information of an automatic door. Thus, the above described arrangement 100 may be implemented as a retrofitted arrangement in an already existing automatic door system regardless of the producer of the automatic door system, wherein the automatic door system may comprise at least the automatic door and the door control system. This means that the arrangement according to invention may be arranged to any automatic door. Alternatively, the arrangement according to the invention may be used to obtain additional state information of an automatic door in addition to the information obtained by means of the door control system.

The specific examples provided in the description given above should not be construed as limiting the applicability and/or the interpretation of the appended claims. Lists and groups of examples provided in the description given above are not exhaustive unless otherwise explicitly stated.

The invention claimed is:

1. A system configured to detect at least one operational parameter of an automatic door including at least one of state information or position information, the system comprising:

a magnetometer on a first one of a moving part of the automatic door, or a structure that is separate from the moving part of the automatic door, the magnetometer is configured to detect data representing a magnetic field;

at least one permanent magnet on a second one of the moving part of the automatic door, or the structure that is separate from the moving part of the automatic door so that the at least one permanent magnet is in an operational vicinity of the magnetometer at least at one point of a motion path of the automatic door, the at least one permanent magnet configured to generate the magnetic field such that the magnetic field is detectable by the magnetometer during a set time; and a controller configured to, receive and store the data from the magnetometer, and determine the at least one operational parameter of the automatic door from the data such that the state information of the automatic door is determined by comparing the data to an idle noise of the magnetometer.

2. The system according to claim 1, wherein the controller is configured to determine the state information by, determining that a state of the automatic door is moving, if a variance of the data is defined to be higher than the idle noise of the magnetometer, determining that a state of the automatic door is open, if the variance of the data is defined to correspond to the idle noise of the magnetometer and if an average of the data is defined to differ from a door environment specific reference value more than a set limit, or determining that a state of the automatic door is closed, if the variance of the data is defined to correspond to the idle noise of the magnetometer and if the average of the data is defined to differ from the door environment specific reference value less than the set limit.

3. The system according to claim 2, wherein the door environment specific reference value is an average value of previously detected and stored data representing the magnetic field created by the permanent magnet, when the automatic door is in closed state.

4. The system according to claim 1, wherein the controller is configured to determine the position information of the automatic door by comparing the data to a previously generated and stored magnetic map of the motion path of the automatic door, wherein the magnetic map of the motion path of the automatic door represents the magnetic field at each point of the motion path of the automatic door.

5. The system according to claim 4, wherein the controller is configured to determine the position information of the automatic door at the set time such that the set time is the point of the motion path of the automatic door having magnetic field data corresponding to the data.

6. The system according to claim 1, wherein the data is magnetic flux density, wherein the magnetic flux density is a vector quantity having strength and direction.

7. The system according to claim 1, wherein the magnetometer and the controller are implemented as one combined unit.

8. The system according to claim 1, wherein the moving part of the automatic door is one of a hanger plate or a panel.

9. The system according to claim 1, wherein the system is implemented in an elevator environment in order to detect the at least one operational parameter of the automatic door of an elevator car.

10. The system according to claim 1, wherein the system is implemented in a building environment in order to detect the at least one operational parameter of the automatic door of a building.

11. A method for detecting at least one operational parameter of an automatic door including at least one of state information or position information, the method comprising:

obtaining, from a magnetometer, data representing a magnetic field generated by at least one permanent magnet during a set time, the magnetometer being on a first one of a moving part of the automatic door, or a structure that is separate from the moving part of the automatic door, and the at least one permanent magnet being on a second one of the moving part of the automatic door, or the structure that is separate from the moving part of the automatic door so that the at least one permanent magnet is in an operational vicinity of the magnetometer at least at one point of a motion path of the automatic door;

storing the data from the magnetometer; and determining the at least one operational parameter of the automatic door from the data such that the state information of the automatic door is determined by comparing the data to an idle noise of the magnetometer.

12. The method according to claim 11, wherein the determining comprises:

determining that a state of the automatic door is moving, if a variance of the data is defined to be higher than the idle noise of the magnetometer, determining that a state of the automatic door is open, if the variance of the data is defined to correspond to the idle noise of the magnetometer and if an average of the data is defined to differ from a door environment specific reference value more than a set limit, or determining that a state of the automatic door is closed, if the variance of the data is defined to correspond to the idle noise of the magnetometer and if the average of the data is defined to differ from the door environment specific reference value less than the set limit.

13. The method according to claim 11, wherein determining comprises:

determining the position information of the automatic door by comparing the data to a previously generated and stored magnetic map of the motion path of the automatic door, wherein the magnetic map of the motion path of the automatic door represents the magnetic field at each point of the motion path of the automatic door.

14. The method according to claim 13, wherein the determining determines the position information of the automatic door at the set time such that the set time is the point of the motion path of the automatic door having magnetic field data corresponding to the data.

15. A controller of an automatic door comprising:

processing circuitry configured to detect at least one operational parameter of the automatic door including at least one of state information or position information by, obtaining, from a magnetometer, data representing a magnetic field generated by at least one permanent magnet during a set time, the magnetometer being on a first one of a moving part of the automatic door, or a structure that is separate from the moving part of the automatic door, and the at least one permanent magnet being on a second one of the moving part of the automatic door, or the structure that is separate from the moving part of the automatic door so that the at least one permanent magnet is in an operational vicinity of the magnetometer at least at one point of a motion path of the automatic door, storing the data from the magnetometer, and determining the at least one operational parameter of the automatic door from the data such that the state information of the automatic door is determined by comparing the data to an idle noise of the magnetometer.

16. The controller of claim 15, wherein the processing circuitry is configured to determine the position information of the automatic door by comparing the data to a previously generated and stored magnetic map of the motion path of the automatic door, wherein the magnetic map of the motion path of the automatic door represents the magnetic field at each point of the motion path of the automatic door.

* * * * *